US009077070B2

(12) United States Patent
Zimmerman et al.

(10) Patent No.: US 9,077,070 B2
(45) Date of Patent: Jul. 7, 2015

(54) TRI-POLE ANTENNA ELEMENT AND ANTENNA ARRAY

(75) Inventors: Martin Lee Zimmerman, Chicago, IL (US); Igor E. Timofeev, Dallas, TX (US); Ligang Wu, Jiangsu (CN)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 346 days.

(21) Appl. No.: 13/462,198

(22) Filed: May 2, 2012

(65) Prior Publication Data

US 2012/0280879 A1 Nov. 8, 2012

Related U.S. Application Data

(60) Provisional application No. 61/481,387, filed on May 2, 2011.

(51) Int. Cl.

| | |
|---|---|
| ***H01Q 21/26*** | (2006.01) |
| ***H01Q 21/00*** | (2006.01) |
| ***H01Q 1/24*** | (2006.01) |
| ***H01Q 19/24*** | (2006.01) |
| ***H01Q 21/06*** | (2006.01) |
| ***H01Q 21/24*** | (2006.01) |

(52) U.S. Cl.

CPC ..... *H01Q 1/246* (2013.01); *H01Q 19/24* (2013.01); *H01Q 21/062* (2013.01); *H01Q 21/24* (2013.01)

(58) Field of Classification Search

CPC ..... H01Q 1/246; H01Q 21/24; H01Q 21/062; H01Q 19/24

See application file for complete search history.

(56) References Cited

U.S. PATENT DOCUMENTS

| | | | | |
|---|---|---|---|---|
| 4,315,264 | A * | 2/1982 | DuHamel | 343/797 |
| 5,270,872 | A * | 12/1993 | Spry | 359/885 |
| 5,280,297 | A * | 1/1994 | Profera, Jr. | 343/754 |
| 6,747,606 | B2 * | 6/2004 | Harel et al. | 343/808 |
| 8,199,063 | B2 * | 6/2012 | Moon et al. | 343/810 |
| 8,558,747 | B2 * | 10/2013 | Lytle et al. | 343/797 |

(Continued)

FOREIGN PATENT DOCUMENTS

| | | |
|---|---|---|
| EP | 1367672 | 12/2003 |
| EP | 2079132 | 7/2009 |
| GB | 2424765 | 10/2006 |

OTHER PUBLICATIONS

Written Opinion for related PCT Patent Application No. PCT/US2012/036000 dated Nov. 5, 2013, 7 pages.

(Continued)

*Primary Examiner* — Trinh Dinh

(74) *Attorney, Agent, or Firm* — Husch Blackwell, LLP

(57) ABSTRACT

A dual polarized base station antenna is provided, including a reflector having a longitudinal axis and an array of tri-pole elements disposed on the reflector. Each tri-pole element has a first side arm and a second side arm. The tri-pole element also includes a center arm which is approximately perpendicular to the first and second side arms. The tri-pole elements are oriented such that either the side arms or the center arm are parallel to the longitudinal axis of the reflector. The antenna further includes a feed network having a first signal path coupled to the first arms of the tri-pole elements and a second signal path coupled to the second anus of the tri-pole elements. In this example, the array of tri-pole elements produces a cross-polarized beam at +45 degrees and −45 degrees from the longitudinal axis. Tri-pole arrays may be used in a multiband antenna.

20 Claims, 19 Drawing Sheets

(56) References Cited

U.S. PATENT DOCUMENTS

| | | | | |
|---|---|---|---|---|
| 2006/0273865 | A1* | 12/2006 | Timofeev et al. | 333/161 |
| 2009/0058752 | A1 | 3/2009 | Lee et al. | |
| 2009/0224994 | A1* | 9/2009 | Le et al. | 343/797 |
| 2009/0224995 | A1* | 9/2009 | Puente et al. | 343/850 |
| 2009/0278759 | A1* | 11/2009 | Moon et al. | 343/810 |
| 2010/0033396 | A1* | 2/2010 | Tanabe et al. | 343/834 |
| 2010/0134374 | A1* | 6/2010 | Skalina et al. | 343/798 |
| 2011/0175782 | A1* | 7/2011 | Choi et al. | 343/798 |
| 2014/0253407 | A1* | 9/2014 | Puente et al. | 343/872 |

OTHER PUBLICATIONS

Written Opinion of related PCT App. No. PCT/US2012/036000 dated Nov. 5, 2013, 6 pages.

* cited by examiner

TRI-POLE ANTENNA ELEMENT AND ANTENNA ARRAY

CROSS-REFERENCE TO RELATED APPLICATION

This application claims priority to and incorporates by reference U.S. Provisional Patent Application No. 61/481,387, Filed on May 2, 2011 and titled "Tri-Pole Antenna Element And Antenna Array."

BACKGROUND

Antennas for wireless voice and/or data communications typically include an array of radiating elements connected by one or more feed networks. For efficient transmission and reception of Radio Frequency (RF) signals, the dimensions of radiating elements are typically matched to the wavelength of the intended band of operation. Because the wavelength of the GSM 900 band (e.g., 880-960 MHz) is longer than the wavelength of the GSM 1800 band (e.g., 1710-1880 MHz), the radiating elements for one band are typically not used for the other band. Radiating elements may also be dimensioned for operation over wider bands, e.g., a low band of 698-960 MHz and a high band of 1710-2700 MHz. In this regard, dual band antennas have been developed which include different radiating elements for each of the two bands. See, for example, U.S. Pat. No. 6,295,028, U.S. Pat. No. 6,333,720, U.S. Pat. No. 7,238,101 and U.S. Pat. No. 7,405,710, the disclosures of which are incorporated by reference.

Additionally, base station antennas (BSA) with +/−45 degree slant polarizations are widely used for wireless communications. Two polarizations are used to overcome of multipath fading by polarization diversity reception. The vast majority of BSA have +/−45 degree slant polarizations. Examples of prior art can be crossed dipole antenna element U.S. Pat. No. 7,053,852, or dipole square ("box dipole"), U.S. Pat. No. 6,339,407 or U.S. Pat. No. 6,313,809, having 4 to 8 dipole arms. Each of these patents are incorporated by reference. The +/−45 degree slant polarization is often desirable on multiband antennas.

In known multiband antennas, the radiating elements of the different bands of elements are combined on a single panel. See, e.g., U.S. Pat. No. 7,283,101, FIG. 12; U.S. Pat. No. 7,405,710, FIG. 1, FIG. 7. In these known dual-band antennas, the radiating elements are typically aligned along a single axis. This is done to minimize any increase in the width of the antenna when going from a single band to a dual band antenna. Low-band elements are the largest elements, and typically require the most physical space on a panel antenna.

While +/−45 degree slant polarization is often desired, there are difficulties with using known validating elements to make a compact ±45 degree polarized antenna. Known crossed dipole-type elements, for example, are known to have undesirable coupling with crossed-dipole elements of another band situated on the same antenna panel. This is due, at least in part, to the orientation of the dipoles at ±45 degree to the vertical axis of the panel antenna.

The radiating elements may be spaced further apart to reduce coupling, but this would increase the size of the multiband antenna and produce grating lobes. An increase in panel antenna size may have several undesirable drawbacks. For example, a wider antenna may not fit in an existing location or, if it may physically be mounted to an existing tower, the tower may not have been designed to accommodate the extra wind loading of a wider antenna. Also, zoning regulations can prevent of using bigger antennas in some areas.

An object of the present invention is to create more compact +/−45 degree polarized antenna. Another object is to reduce the cost of base station antennas. Size and cost reduction of base station antennas (BSA) is vital for wireless communication systems.

SUMMARY

A dual polarized base station antenna is provided. According to one aspect, the base station antenna includes a reflector having a longitudinal axis and an array of tri-pole elements disposed on the reflector. Each tri-pole element has a first side arm and a second side arm. The tri-pole element also includes a center arm which is approximately perpendicular to the first and second side arms. The tri-pole elements are oriented such that either the side arms or the center arm are parallel to the longitudinal axis of the reflector. The antenna further includes a feed network having a first signal path coupled to the first side arms of the tri-pole elements and a second signal path coupled to the second side arms of the tri-pole elements. In this example, the array of tri-pole elements produces a cross-polarized beam at +45 degrees and −45 degrees from the longitudinal axis.

The array of tri-pole elements may include a first set of tri-pole elements offset to the left with respect to the longitudinal axis and a second set of tri-pole elements offset to the right with respect to the longitudinal axis. The array of tri-pole elements may also include a combination of elements facing up and elements facing to the side.

In another embodiment a multiband antenna is provided. Due to the compact nature of the array of tri-pole elements, an additional array (or arrays) of radiating elements may be included to provide separately controlled sub-bands and/or multi-band operation.

DETAILED DESCRIPTION

Figure 1:
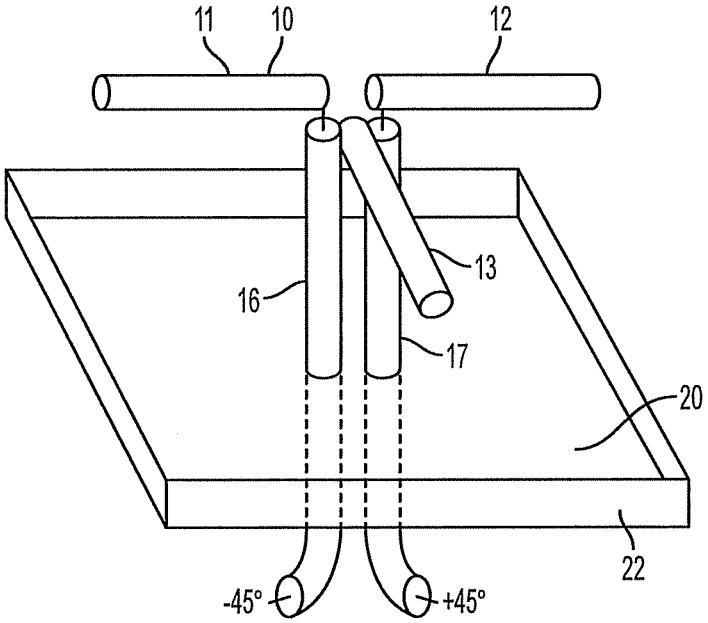
FIG. 1 illustrates a tri-pole radiating element according to one aspect of the present invention based on coaxial lines.

According to one aspect of the present invention, as illustrated in FIG. 1, a ti-pole radiating element 10 has three arms: two side arms 11, 12 and central arm 13. The length of each arm is about one quarter wavelength of the operating frequency band. Side arms 11, 12 are connected to the central conductor of coaxial feeds 16, 17, respectively. Central arm 13 is connected to outer conductor of coaxial lines 16 and 17.

The outer conductors of coaxial lines 16 and 17 are connected to a reflector 20. The reflector is spaced about one quarter-wave length distance from side arms 11, 12 and central arm 13 to prevent currents on outer surface of the coaxial lines 16 and 17 (balun), so lines 16 and 17 are invisible for radiation field. In one embodiment, the three arms 11, 12 and 13 define a plane which is parallel to the plane of the reflector. In alternate embodiments, the side arms 11, 12 and central arm 13 may be tilted up or down with respect to the plane of the reflector for beamwidth and/or cross-polarization adjustment.

Input impedance of tri-pole radiating element 10 is close to 50 Ohm for both polarizations, so common 50 Ohm cables may be used.

Figure 2:
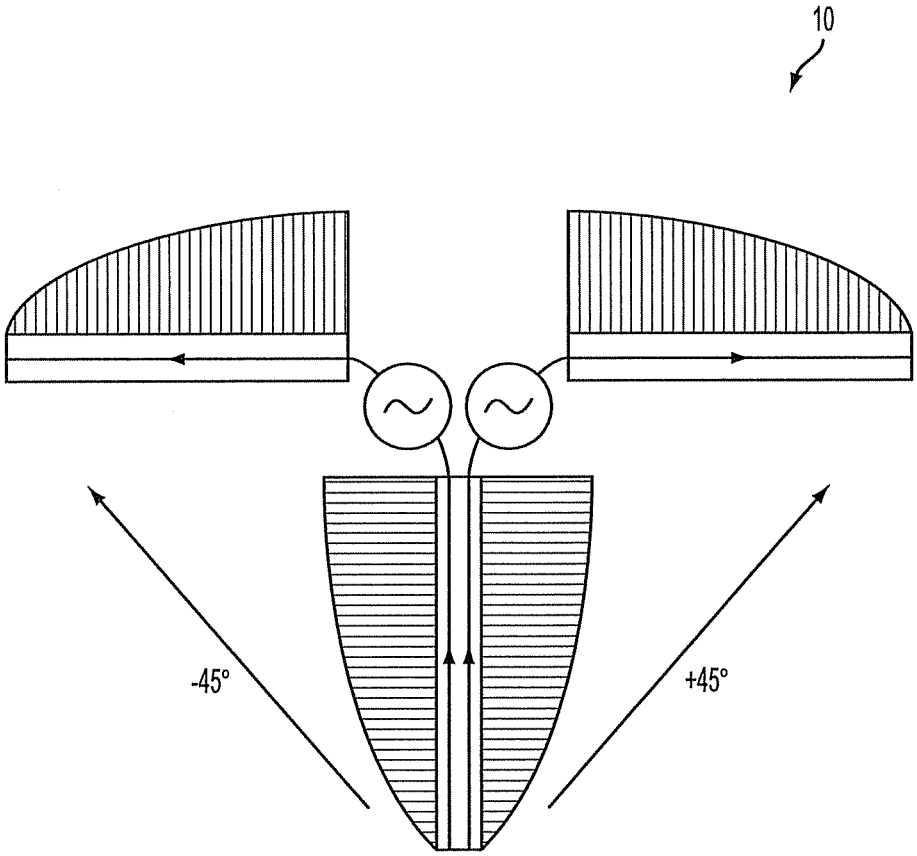
FIG. 2 illustrates the electromagnetic fields produced by a tri-pole radiating element according to one aspect of the present invention.

A tri-pole radiating element may be considered as a combination of 2 dipoles with arms bent by 90 degrees. Referring to FIG. 2, an equivalent diagram shows currents on the arms and polarization vectors of radiation field (+45 and −45 slant polarizations). It is important to note that the +45 degree slant and −45 degree slant are with respect to side arms 11 and 12. Thus, side arms 11 and 12 may be oriented horizontally or vertically with respect to the longitudinal axis of the reflector to achieve ±45 degree polarization. This is in contrast to a conventional dipole, where the radiated field is at zero degrees slant from the dipole, and dipoles must be oriented at ±45 degrees from vertical to achieve ±45 degree slant polarization. This feature of the tri-pole is important for multiband array applications, where radiators of different bands are confined in the same aperture.

Advantages of tri-pole include symmetry of pattern, compactness, easy feed and low cost. Lower cost is achieved because only 3 arms are used. In contrast, prior art dual polarized dipoles may have 4 to 8 arms. A tri-pole radiating element provides radiation with two orthogonal polarizations, so high port-to-port isolation can be achieved (25-30 dB). A tri-pole radiating element has the same beamwidth for E and H field components.

Additionally, the tri-pole radiating element is physically smaller than a conventional cross dipole or patch radiator. For example, the width of tri-pole is about 0.25 wavelength, or 30-50% less than existing dual-polarized radiators (0.35 wavelength for cross-dipole, 0.5 wavelength for patch radiator). Compactness is important for many antenna applications.

In the example of FIG. 1, a coaxial cable is used to feed the tri-pole radiating element. However, other types of feed lines (microstrip line, strip line, coplanar line) may be used for feeding tri-pole. For example, in FIGS. 3 and 4, two microstrip lines 30, 32 with air dielectric and common ground conductor 34 are used as +45 degree and −45 degree feeds. Side arms 11*a* and 12*a* and central arm 13*a*, are formed integrally with the feed structure. For example, side arm 11*a* may be stamped from the same sheet of metal as microstrip 30, side awl 12*a* may be stamped from the same sheet of metal as microstrip 32, and central arm 13 may be stamped from the same sheet of metal as ground conductor 34. Alternatively, dielectric substrates may be used to form microstrip lines. Balanced lines (when strip conductor has about the same width as ground conductor) may also be used. The ground conductor 34 for microstrip lines may be common (as shown) or separated. Depending on the tri-pole height (usually about one-quarter wavelength), arm shape, reflector size and ridges height, 3 dB beamwidth may vary from 60 to 95 degrees. Ridges 22 may be added. Ridge height may vary from zero to one-quarter wavelength.

Figure 3:
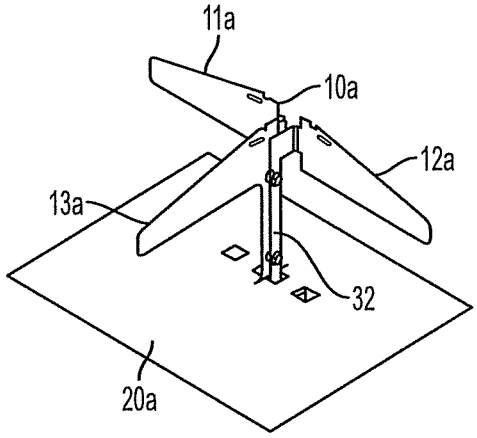
FIG. 3 is a perspective view of another example of a tri-pole radiating element according to one aspect of the present invention based on a flat pattern.
Figure 4:
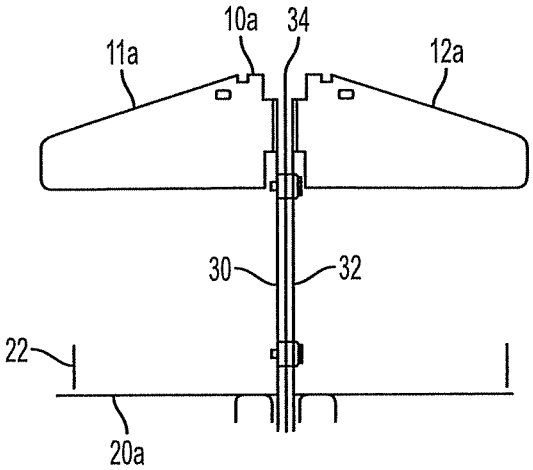
FIG. 4 is a side view of a tri-pole radiating element of FIG. 3.
Figure 5:
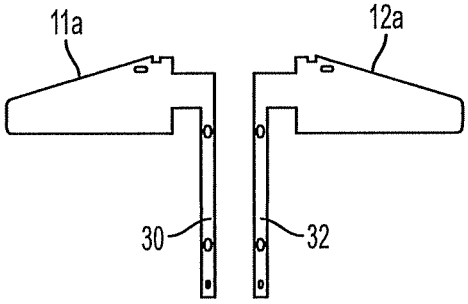
FIG. 5 illustrates components of the tri-pole radiating element of FIG. 3.
Figure 6:
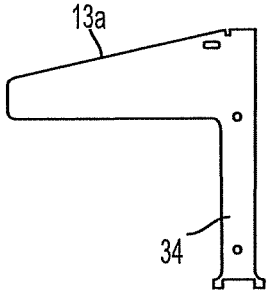
FIG. 6 illustrates additional components of the tri-pole radiating element of FIG. 3.

Referring to FIGS. 5 and 6, the elements of the tri-pole radiating element 10*a* of FIGS. 3 and 4 are shown prior to final shaping and assembly. FIG. 5 includes side arms 11*a* and 11*b* and microstrip lines 30 and 32 (flat pattern). FIG. 6 shows central arm 13*a* and a ground conductor 34 for the microstrip lines.

Figure 7:
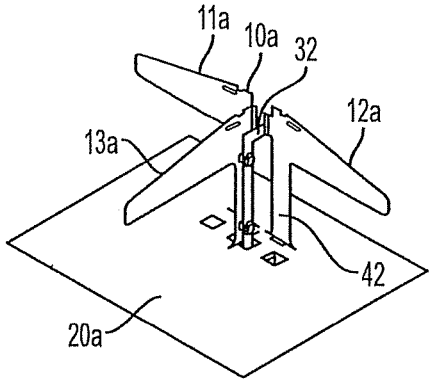
FIG. 7 is a perspective view of another example of a tri-pole radiating element according to one aspect of the present invention.
Figure 8A:
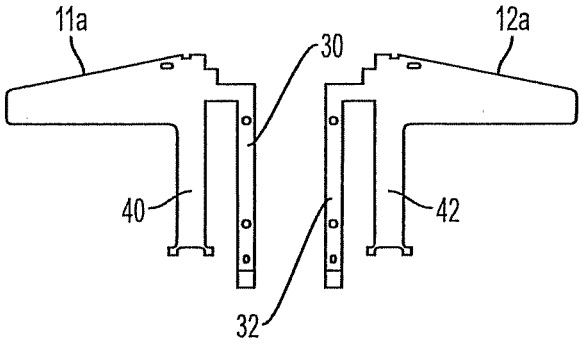
FIG. 8*a* illustrates components of the tri-pole radiating element of FIG. 7.
Figure 8B:
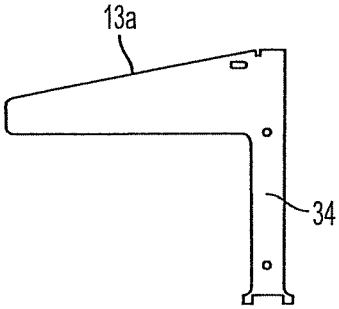
FIG. 8*b* illustrates additional components of the tri-pole radiating element of FIG. 7.

Referring to FIGS. 7, 8*a* and 8*b*, to increase mechanical strength of tri-pole, two additional supports 40, 42 may be added (working also as a one-quarter wavelength balun), mechanically and electrically connected to the reflector 20*a*. The length of all three supports is about one-quarter wavelength, which make them invisible for radiation field; there are no radiation currents on all of three supports.

Figure 9A:
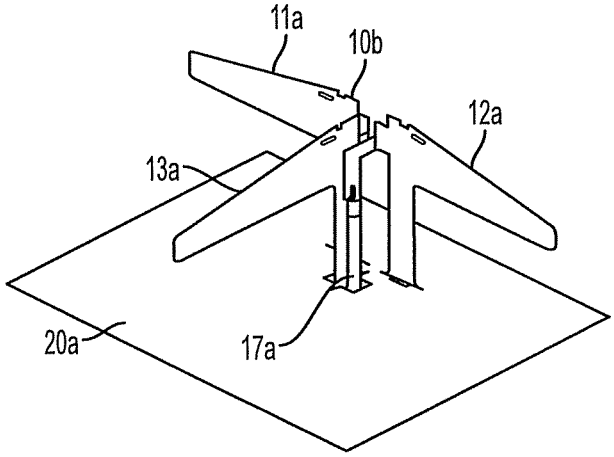
FIG. 9*a* is a perspective view of another example of a tri-pole radiating element according to one aspect of the present invention.
Figure 9B:
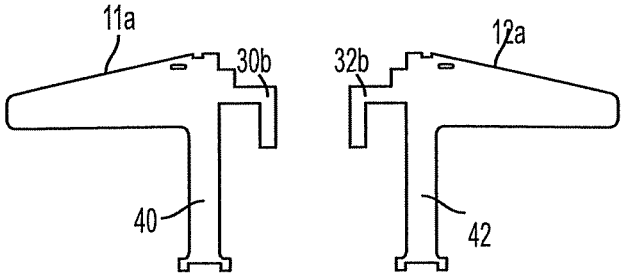
FIG. 9*b* illustrates components of the tri-pole radiating element of FIG. 9.

In an alternative embodiment illustrated in FIGS. 9*a* and 9*b*, the tri-pole elements are fabricated to accept two coaxial cables 17*a* connected to the arms. For each of the side arms 11*a*, 12*a*, short section of microstrip line 30*b*, 32*b* may be used for impedance matching.

Figure 10A:
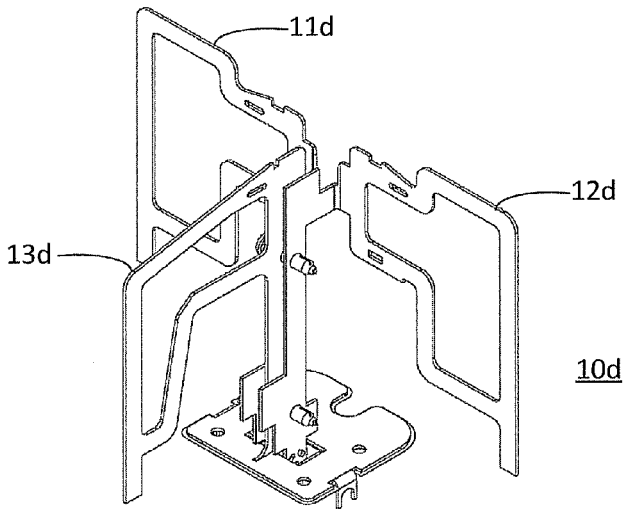
FIG. 10*a* is a perspective view of another example of a tri-pole radiating element according to one aspect of the present invention.
Figure 10C:
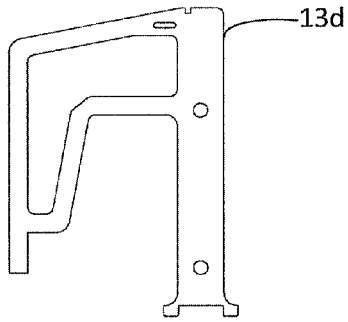
FIG. 10*c* illustrates side components of the example of FIG. 10*a*.
Figure 10B:
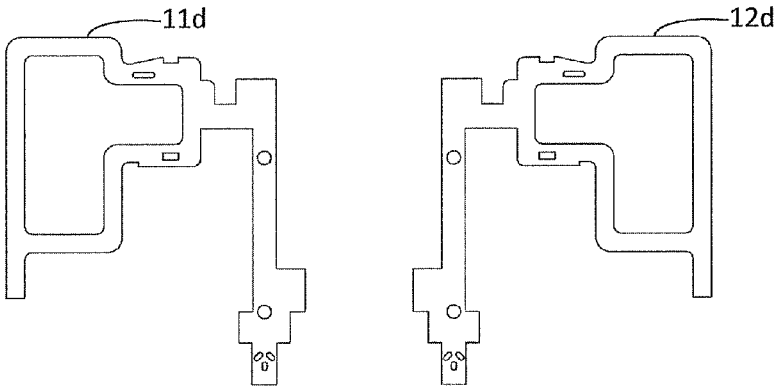
FIG. 10*b* is a central component of the example of FIG. 10*a*.

FIGS. 10*a*, 10*b* and 10*c* illustrate another example of a tri-pole element 10*d*. Tri-pole element 10*d* includes wide loop side arms 11*d*, 12*d* and wide loop central arm 13*d*. A main advantage of this element, when it is used for multiband arrays is less interference with a high band signal (1710-2700 MHz) from an adjacent high band array. Another advantage is smaller size.

Figure 11A:
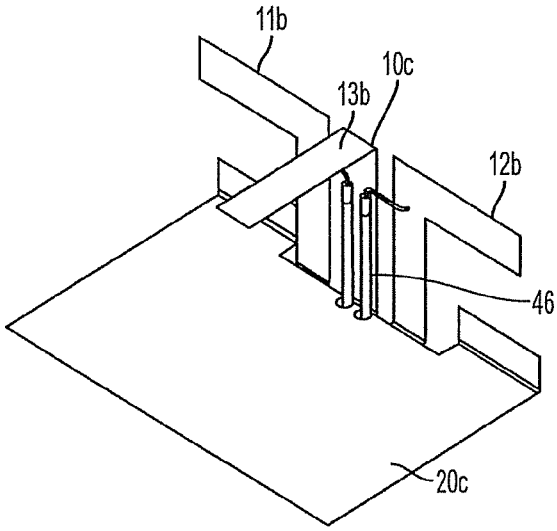
FIG. 11*a* is a perspective view of another example of a tri-pole radiating element according to one aspect of the present invention.
Figure 11B:
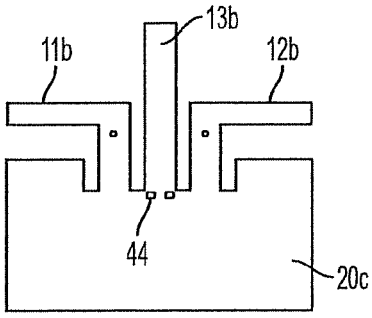
FIG. 11*b* illustrates components of the tri-pole radiating element of FIG. 11*a*.
Figure 12:
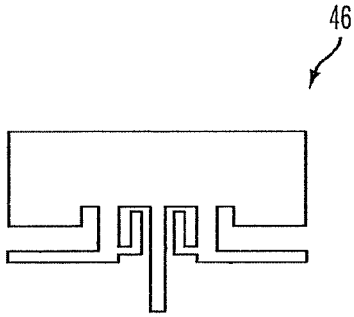
FIG. 12 illustrated an alternate stamping pattern for forming a tri-pole element according to the example of FIG. 11*a*.

In another example illustrated in FIGS. 11*a* and 11*b*, for further cost reduction, the reflector and tri-pole element may be made from the same piece of sheet metal. In this example the tri-pole radiating element 10*c* is cut from the reflector stock and then bent out of plane. Coaxial feeding is shown in FIG. 11*a*. Holes 44 are provided to allow for coaxial cables 4*b* to pass through the reflector 20*c*. Microstrip feeds are also possible. For example, one strip on one side of central support, another on another side. Referring to FIG. 12, a cut piece of sheet metal stock 46 for forming one piece tri-pole radiating element with coplanar strip feeds is shown.

Figure 13:
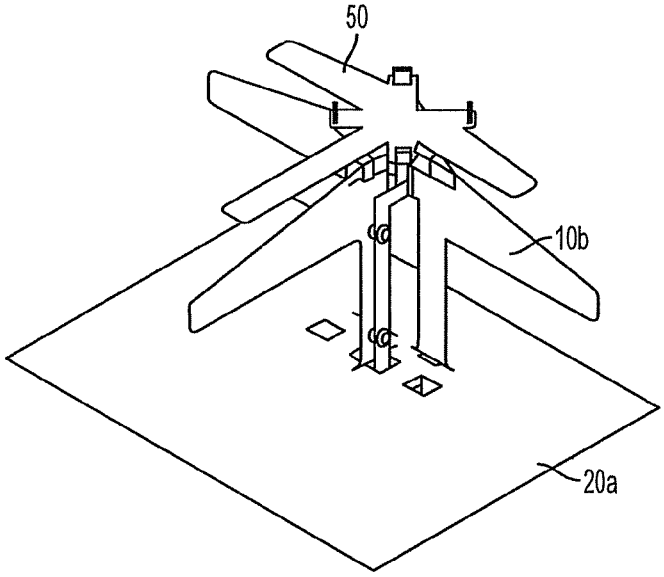
FIG. 13 is a perspective view of another example of a tri-pole radiating element according to one aspect of the present invention assembled with a director.
Figure 14:
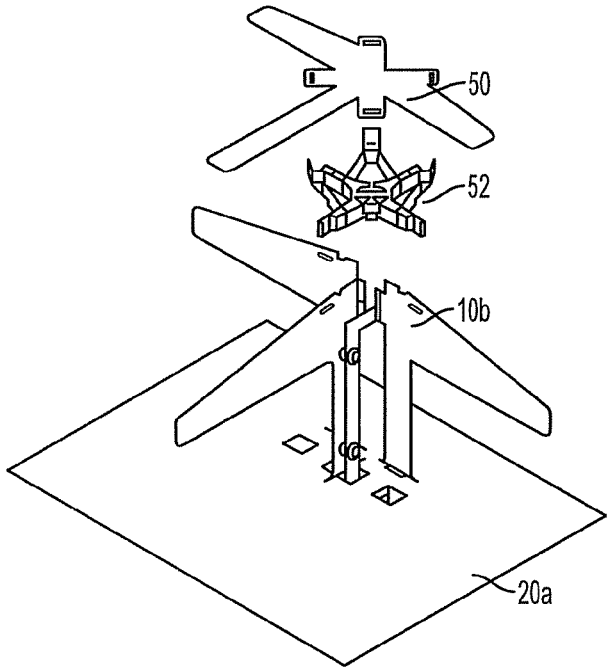
FIG. 14 is an exploded view of the tri-pole radiating element of FIG. 13.

Referring to FIGS. 13 and 14, T-shaped directors 50 may be included to help pattern shaping and decrease beamwidth. These may be considered analogous to Yagi-Uda antenna directors. The T-shaped directors 50 may help to increase operational frequency bandwidth.

In one example, as illustrated, one T-shaped director 50 is shown, but several directors may be added. A plastic support 52 may be provided to space the T-shaped director 50 off the tri-pole radiating element 10*b*. Also, bending of the edge portion of director arms (up or down) can be used for port-to-port isolation tuning, to get a desirable level of 25-30 dB.

Figure 15:
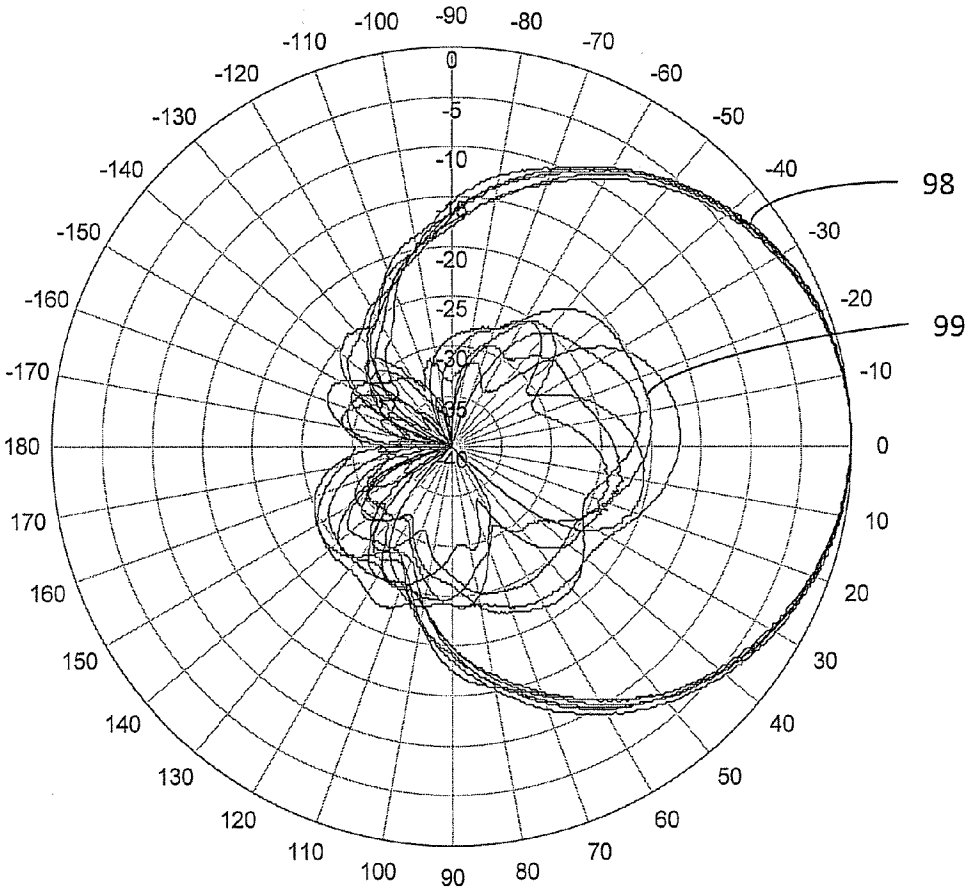
FIG. 15 is a radiation pattern of an antenna array according to one example of the present invention.

FIG. 15, concerns an example of a radiating pattern (co-polar 98 and cross-polar 99) of a tri-pole radiating element with one T-shaped director 50 located on a reflector with sides of about one wavelength and 0.15 wavelength ridges. In this example, measured parameters are as follows for 790-960 MHz band:

- Beamwidth is 65 degrees+/−3 degrees
- Azimuth squint is less than 2 degrees
- Front-to-back ratio is greater than 25 dB for a 180 degree+/−30 degree cone
- Cross polar ratio is greater than 12 dB in +/−60 degree sector
- Both ports (with +45 and −45 degree polarization) have the same symmetrical pattern (with the same beamwidth in E- and H-planes)
- Return loss is greater than 20 dB
- Port-to-port isolation is greater than 30 dB
- With several T-shaped directors, beamwidth in both planes can be adjusted to 30 to 50 degrees, the same for both polarizations, and about the same in azimuth and elevation planes.

A tri-pole radiating element 10 may be used as independent antenna or element of antenna array. For example, a plurality of radiating elements array may be mounted on a reflector. The reflector may include ridges to improve F/B ratio or to control beamwidth adjustment.

In FIGS. 16-33, several examples are illustrated of tri-pole elements 10 being used as elements of base station antennas (BSA) for cellular systems with dual +/−45 degree slant polarization. In these examples, various azimuth beamwidths are achieved (from 45 degree to 90 degrees). Any of the foregoing examples of tri-pole elements 10, 10*a*, 10*b*, 10*c* described above may be used. Additionally, any or all of the following examples may include T-shaped directors 50. As it will be shown below, by using tri-pole radiating elements, the width of BSA can be reduced by about 20% to 30%, which is results in low windload, less visual impact, lower cost and weight of the BSA.

Figure 17:
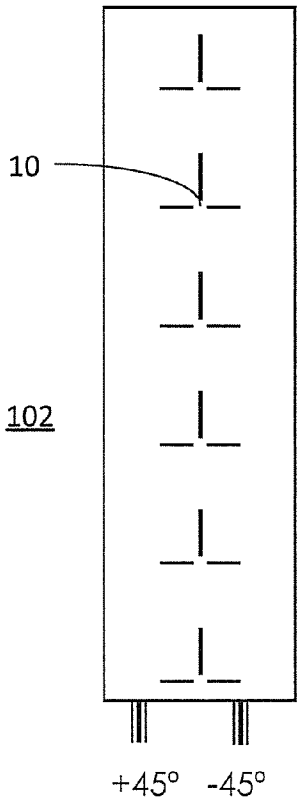
FIG. 17 is another example of base station antenna including tri-pole elements according to one aspect of the present invention.
Figure 16:
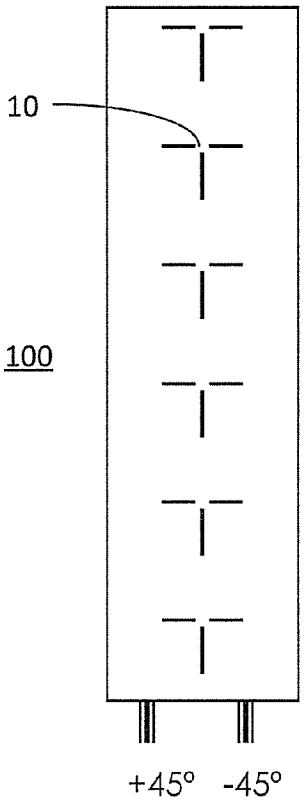
FIG. 16 is an example of base station antenna including tri-pole elements according to one aspect of the present invention.

In FIGS. 16 and 17, examples of an antenna array 100, 102 are shown when all tri-poles are oriented in the same direction (facing down or up) and located in the center of reflector. For example, antenna array 100 has the tri-pole elements 10 facing down, while antenna array 102 has the tri-pole elements 10 facing up. In these examples, the side arms 11, 12 are oriented perpendicular to the vertical axis of the antenna, while center arm 13 is parallel to the center axis (herein, the terms "parallel" and "perpendicular" are referring to orientation with respect to a two-dimensional plan view of the antenna, and are not intended to exclude tilting the tri-pole radiating elements with respect to the surface of the reflector). This orientation results in less coupling between elements in dual-band antennas than conventional cross-dipole elements.

The smaller physical dimensions of the tri-pole radiating elements, in combination with the reduced coupling of the tri-pole elements, allows for a very compact BSA as shown in the examples that are illustrated in FIGS. 16-33. A feed network (not shown) provides each element with phase and amplitude distribution to form desirable radiation pattern in elevation plane. Phase shifters can be part of a feed network for adjustable beam tilt in elevation plane. Connectors for +45 degree and −45 degree polarizations are shown schematically on the bottom of antenna.

Depending on the height of the reflector side ridges, different azimuth beamwidth can be achieved: from 65 degrees (one-quarter wavelength ridge) to 90 degrees (no ridges). The central arm of tri-pole may be parallel to the surface of reflector or turned up or down if need for optimization of antenna parameters (such as cross-polarization or beamwidth). Also, one or more tri-pole elements themselves may be tilted up or down for performance enhancement.

Figure 18:
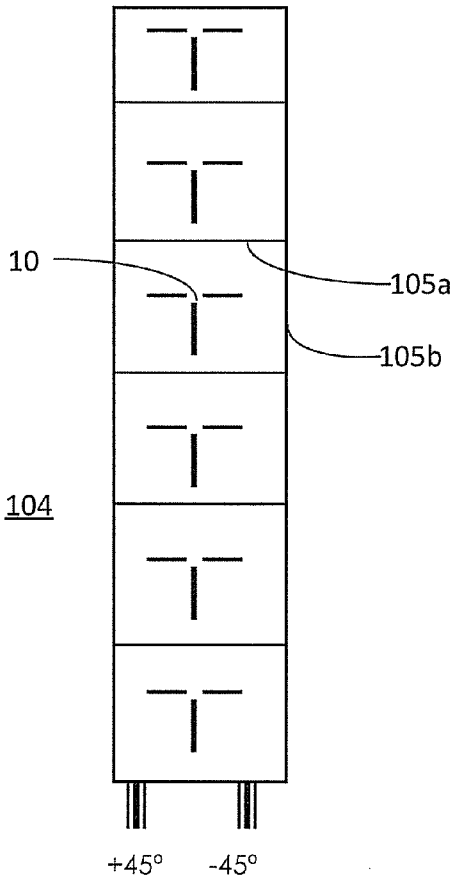
FIG. 18 is another example of base station antenna including tri-pole elements according to one aspect of the present invention.

For example, in FIG. 18, illustrates antenna array 104, which includes walls 105*a* between elements and side ridges 105*b* are provided on the reflector to form cavities around tri-poles. Height of walls may be 0.1-0.25 wavelength. In one example, walls may be connected to the edges of reflector. In another example, the walls are not connected to the reflector. Walls and/or cavities improve azimuth beamwidth stability and azimuth beam squint. Less than +/−2 degree azimuth squint has been measured in 20% frequency bandwidth and at elevation beam tilts from 0 to 16 degrees. Also, walls 105*a* between tri-poles may improve port-to-port isolation and decrease grating lobes in elevation plane.

Figure 19:
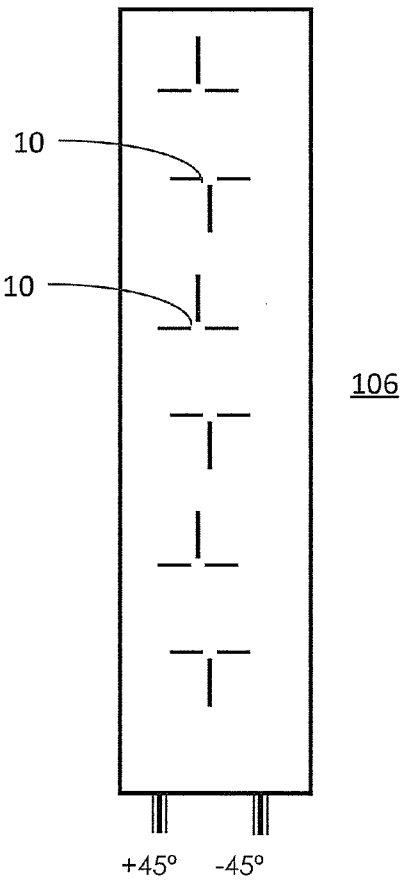
FIG. 19 is another example of base station antenna including tri-pole elements according to one aspect of the present invention.

In the configuration illustrated in FIG. 19, antenna array 106 alternating tri-pole 10 elements may be inverted with respect to each other to improve beam stability and cross-polarization. Horizontal walls (not shown) may also be placed between tri-poles in this configuration to improve antenna performance.

Figure 21:
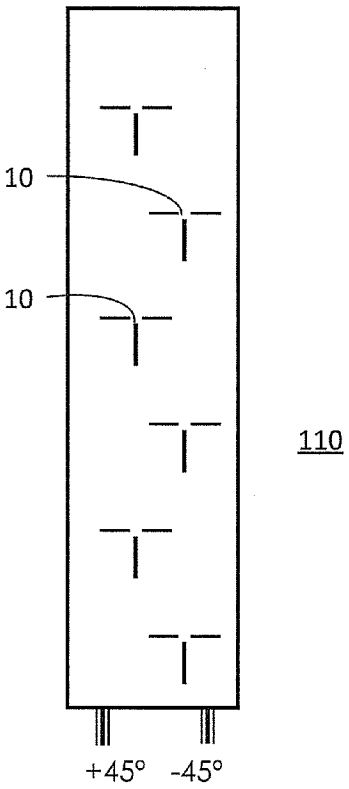
FIG. 21 is another example of base station antenna including tri-pole elements according to one aspect of the present invention.
Figure 20:
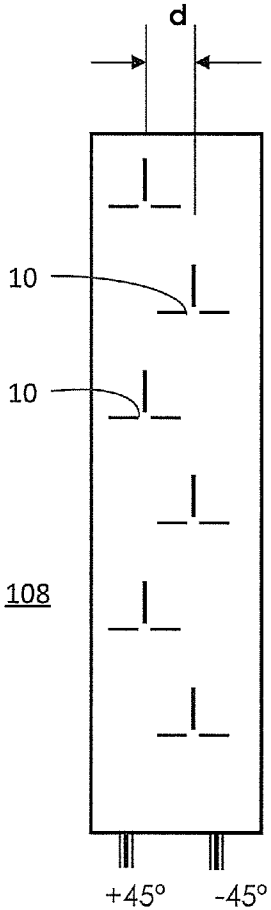
FIG. 20 is another example of base station antenna including tri-pole elements according to one aspect of the present invention.

Referring to FIGS. 20 and 21, tri-pole radiating elements may be offset by distance d (up to 0.3 wavelength) in combination with reflector side ridges (up to 0.25 wavelength) to achieve narrower azimuth beam (as narrow as 55°). For example, FIG. 20 illustrates antenna array 108 having tri-pole elements 10 facing up and offset by distanced. FIG. 21 illustrates antenna array 110 having tri-pole elements 10 facing down and offset by a distance d.

Figure 23:
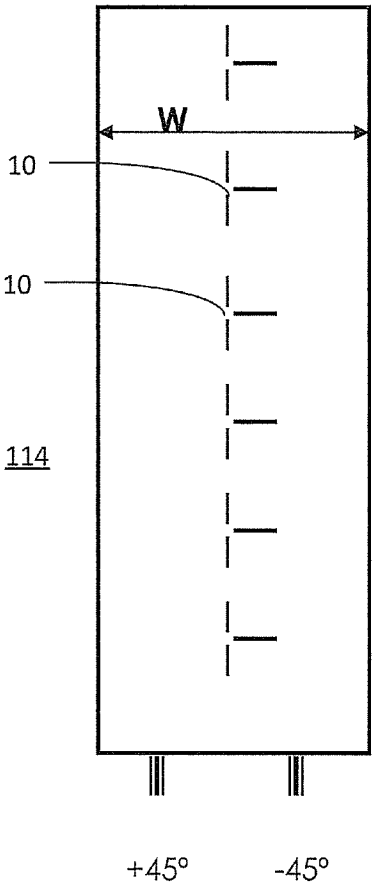
FIG. 23 is another example of base station antenna including tri-pole elements according to one aspect of the present invention.
Figure 22:
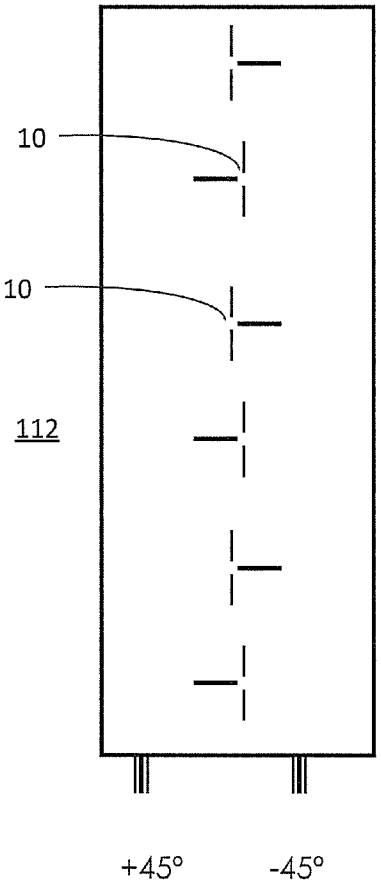
FIG. 22 is another example of base station antenna including tri-pole elements according to one aspect of the present invention.

Referring to FIGS. 22 and 23, very narrow (about one-half wavelength) width of BSA can be achieved with this concept (compare to regular one wavelength), with the same gain: In this configuration, side arms 11, 12 are oriented parallel with the center axis of the reflector, and center arm 13 is perpendicular to the center. In some BSA applications, compactness and/or visual impact of antenna may be more important then front-to-back ratio (F/B). Side ridges of the reflector help to improve F/B ratio.

Referring to FIG. 22, antenna array 112 includes a plurality of tri-pole radiating elements 10. The tri-pole radiating elements 10 are arranged to face opposite directions. The side arms 11, 12 of a left-facing tri-pole element 10 may be offset from a right-facing tri-pole element 10 to reduce the width of the antenna array 112. Referring to FIG. 23, the tri-pole elements 10 of antenna array 114 all face the same direction.

Figures 24, 25, 26:
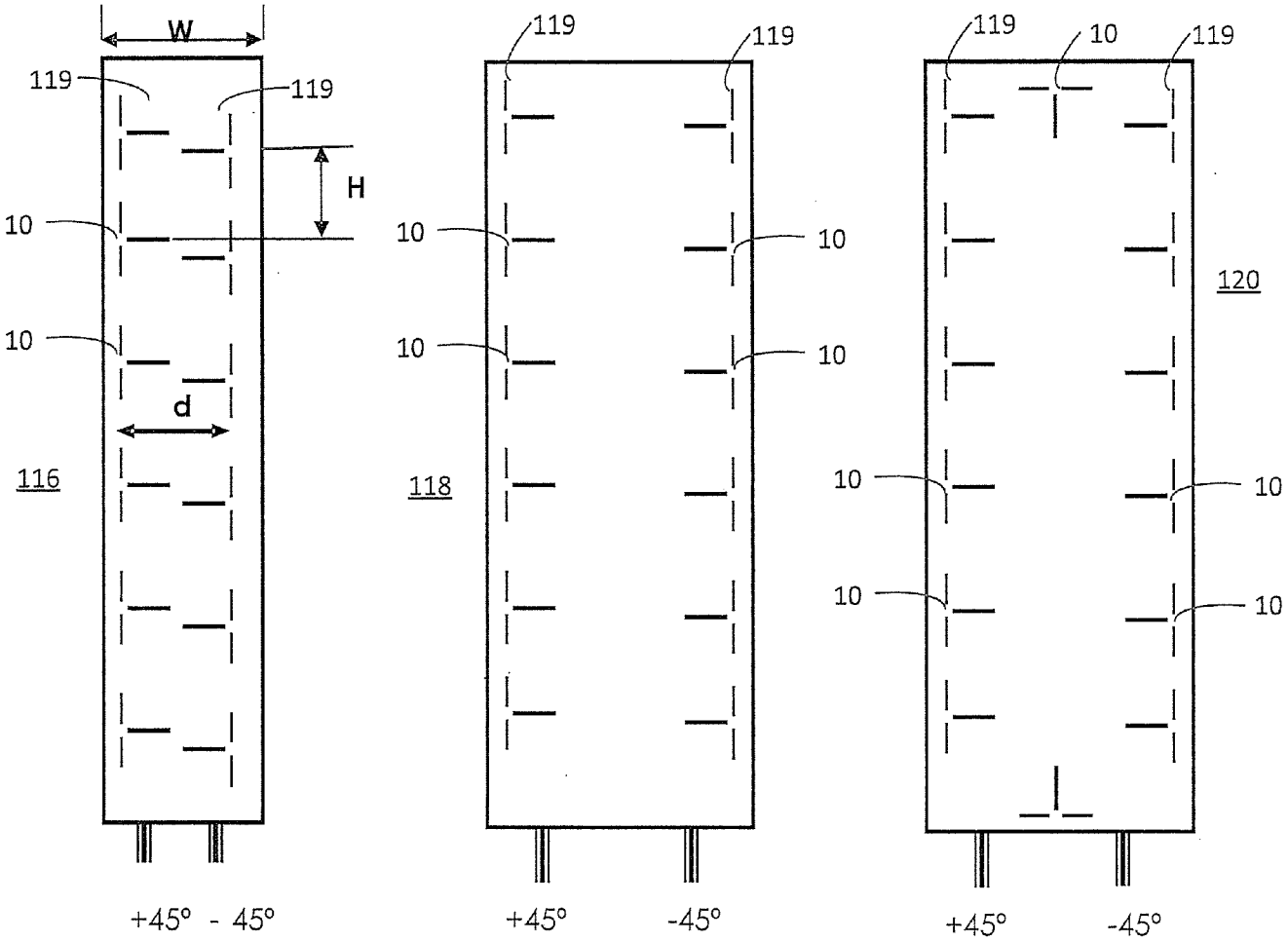
FIG. 24 is another example of base station antenna including tri-pole elements according to one aspect of the present invention.
FIG. 25 is another example of base station antenna including tri-pole elements according to one aspect of the present invention.
FIG. 26 is another example of base station antenna including tri-pole elements according to one aspect of the present invention.

Referring to FIG. 24, antenna array 116 has two columns 119 of tri-pole elements 10 facing each other. The side arms 11 and 12 are oriented vertically and the center arms 13 are oriented horizontally, toward the center of the reflector. Horizontal distance d between columns may vary from one-quarter wavelength (for about 65 degrees azimuth beamwidth) to three-quarter wavelength (for about 35 degrees azimuth beamwidth). Vertical offset H is about half of vertical spacing between radiators in column (which is usually 0.6 to 0.9 wavelength).

Compared to a conventional dual-pole BSA, the example of FIG. 24 provides the same gain with smaller width W, so antenna efficiency is increased by 20-30%. For example, for 790-960 MHz band, antenna width W can be 7-8 inches vs. 10-12 inches for a conventional BSA with 65 degrees azimuth beamwidth (a popular configuration on the market). High ridges/sides of the reflector (about 0.2 wavelength) may be used to keep Front/Back ratio reasonable (close to 25 dB).

Referring to FIG. 25, antenna array 118 includes two columns 119 of tri-pole radiating elements 10 facing each other with a horizontal separation of about 0.7-0.8 wavelength. This example may be used to form azimuth pattern with 40 to 50 degrees beamwidth. BSA with 45 degrees are widely used for 4 and 6 sector cell configurations. The antenna array 118 of FIG. 25 is more compact solution (has about 20% less width) compared to existing BSA with the same beam and gain.

Referring to FIG. 26, antenna array 120 is similar to the example of FIG. 25, with the addition of one or two tri-poles radiating elements 10 added on the top and/or on the bottom as shown for azimuth sidelobe improvement when forming pattern with azimuth beamwidth 35-45 degrees. This example is advantageous in 4-6 sector wireless applications.

Figure 28:
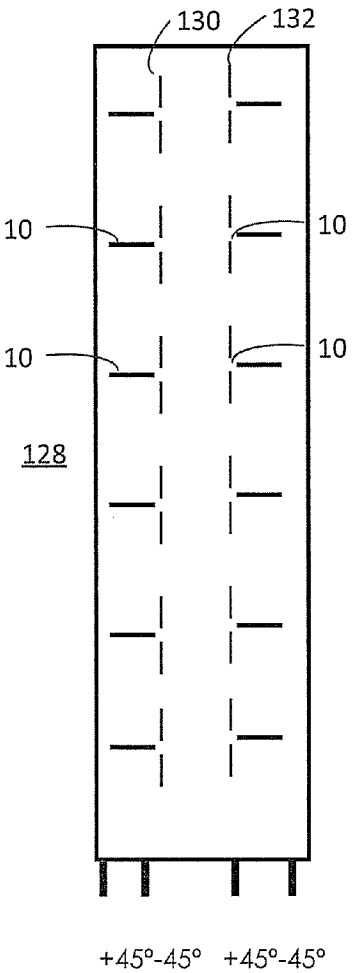
FIG. 28 is another example of a multiband base station antenna including tri-pole elements according to one aspect of the present invention.
Figure 27:
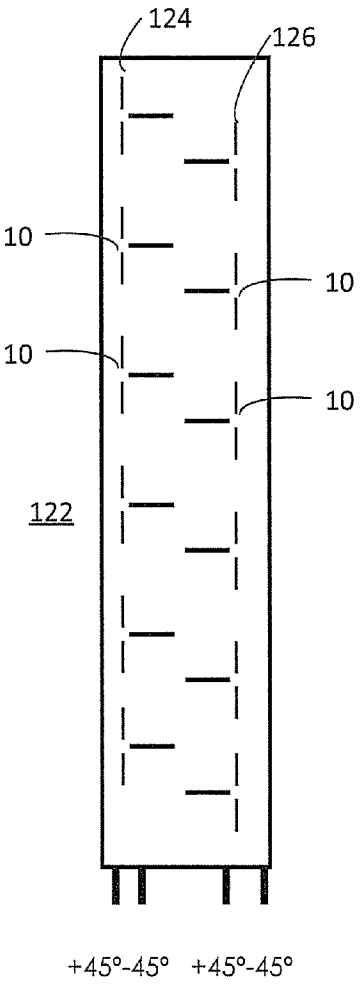
FIG. 27 is an example of a multiband base station antenna including tri-pole elements according to one aspect of the present invention.

In BSA technology, sometimes the same two antennas are placed side-by-side for capacity doubling or individual beam tilt control of sub-bands. Tri-poles allow to reduce width of this 4-port antennas, as shown in FIGS. 27 and 28. For example, a width of 350 mm can be achieved for 790-960 MHz 4-port twin antenna compared to 560 mm of two normal antennas. This reduces wind loading and weight, which allows for less costly, more attractive support structures.

Referring to FIG. 27, for example, antenna array 122 includes a first array of tri-pole elements 124 and a secondary array of tri-pole elements 126. Each of the arrays of tri-pole elements 124, 126 is connected to a separate feed network (not shown). Two sets of +/−45 degree inputs are provided to the antenna array 122. In this example, the individual tri-pole radiating elements face inward. First array 124 can be used, for example, for 790-862 MHz, (Digital Dividend) and second array 126 may be used for 880-960 MHz (GSM 900).

Referring to FIG. 28, antenna array 128 is similar to the example of antenna array 122, however, the individual tri-pole elements 10 of each of the arrays of radiating elements 130, 132 face outward instead of inward.

Figure 29B:
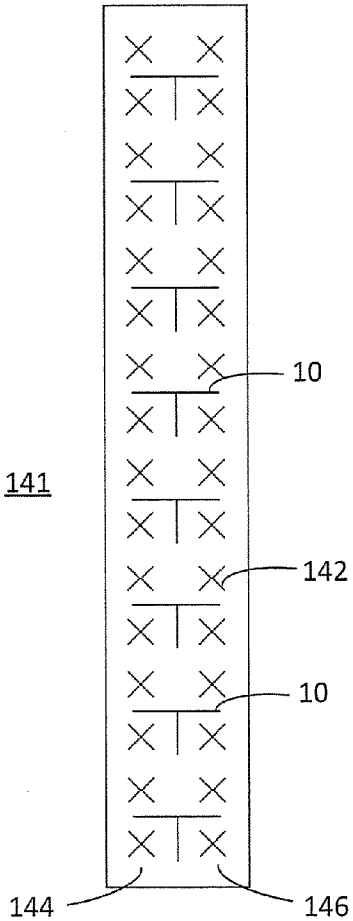
FIG. 29*b* is another example of a multiband base station antenna including tri-pole elements according to one aspect of the present invention.
Figure 29A:
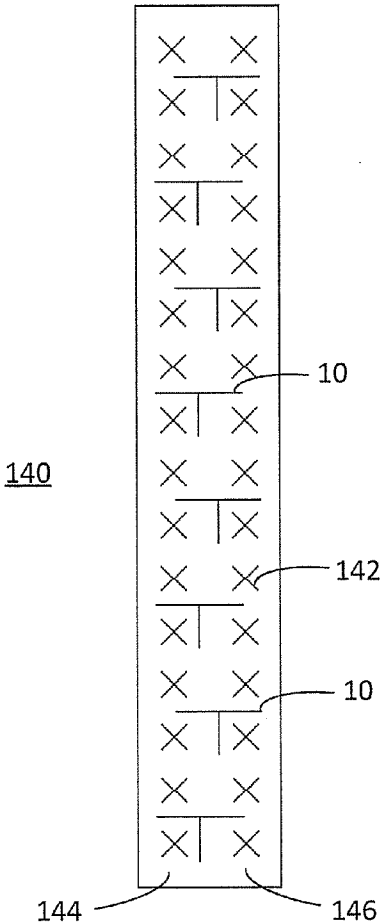
FIG. 29*a* is another example of a multiband base station antenna including tri-pole elements according to one aspect of the present invention.

Referring to FIG. 29*a*, a multiband antenna 140 is illustrated. In this example, tri-pole radiating elements 10 are oriented with side arms 11, 12 perpendicular to the lengthwise axis of the antenna, and the center arm 13 oriented downward, parallel to the lengthwise axis. The tri-pole elements 10 are offset from the center of the reflector tray, alternating sides. Offsetting of the tri-pole elements 10 reduces azimuth beam width to 60-65 degrees. In this example, the tri-pole elements are dimensioned for operation in the low band (698-960 MHz).

FIG. 29*b* is an alternative example of a multiband antenna 141. The multiband antenna 141 of FIG. 29*b* is similar to that of FIG. 29*a*, except that the tri-pole elements 10 are on the center line of the antenna 141. In this example multiband antenna 141 provides a wider azimuth beamwidth of approximately 80-90 degrees with an appropriate reflector width (for example, 10 inches).

High-band elements 142 (1.7-2.7 GHz) are illustrated, in this example, to be conventional crossed dipole elements; but other elements (+zi-poles, Yagi-Uda, patch, open waveguide, etc.) can be used. The crossed dipole elements are arranged in two arrays 144, 146 spaced apart from each other. The arms of the low band tri-pole elements may be located between the high band crossed dipole elements, and do not have significant impact on the high band frequencies. This allows for a more compact dual band antenna (e.g., 300 mm width). Also, because of the lack of coupling and blockage, wide band operation (greater than 45%) may be achieved.

The two arrays of high-band elements have broad applicability. They may be used for capacity doubling (e.g., both operating in the UMTS band), or in different bands (e.g., GSM1800 and UMTS, or UMTS and LTE 2.6). The high band arrays may also be used for 4×2 or 4×4 MIMO (multiple input, multiple output) operation for LTE.

Referring to FIG. 30-33, several different multiband antenna configurations are illustrated. These examples have several pairs of tri-poles facing to each other (see 152 in the figures), to form 65 degree or narrower azimuth beamwidth in a compact housing, such as a width of twelve inches or less. These examples also have several tri-poles opposite to each other in the lengthwise axis of antenna (some face up, some face down, see 154, 164 in the figures). The mixing of facing-up and facing-down tri-poles can significantly improve the cross-polarization, azimuth squint, and front-to-back ratio.

Figure 30:
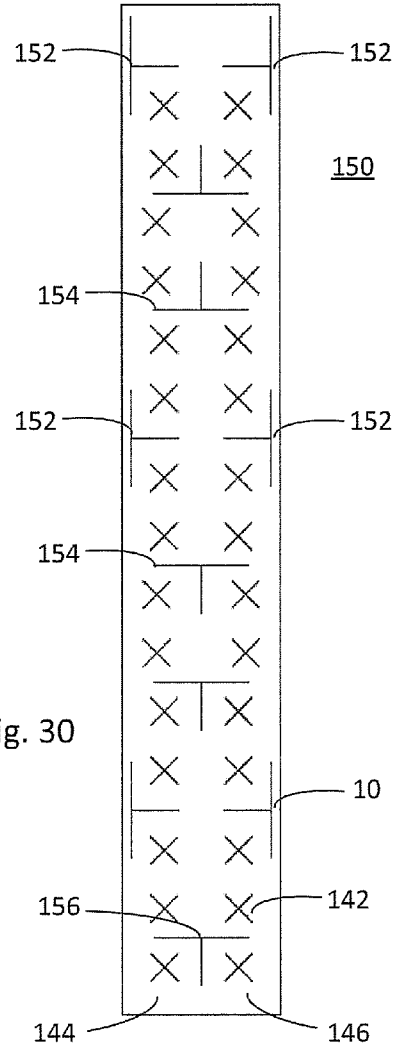
FIG. 30 is another example of a multiband base station antenna including tri-pole elements according to one aspect of the present invention.

Referring to FIG. 30, another example of a multiband antenna 150 is illustrated. In this example, tri-pole elements 10 are low band elements and high band elements 142 are cross dipole elements. The tri-pole elements 10 are arranged in pairs of opposing elements 152 and pairs of center-line tri-poles 154 oriented to be opposite of each other. An additional center-line tri-pole 156 may be added at the bottom of the multiband antenna 150. The number of pairs of radiating elements depends on antenna length and beam width requirements, and may contain additional or fewer pairs of elements. The low band array is symmetrical if the lower tri-pole element 156 is ignored.

Figure 31:
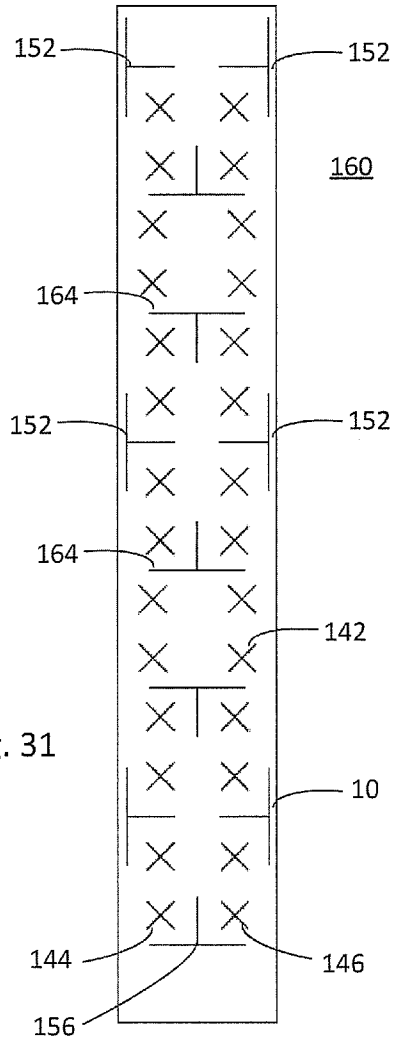
FIG. 31 is another example of a multiband base station antenna including tri-pole elements according to one aspect of the present invention.

Another example of a multiband antenna 160 is illustrated in FIG. 31. In this example, the pairs of center-line tri-pole elements 164 are oriented such that they form a "box" with the pairs of opposing tri-pole elements 152. This example provides good low band azimuth pattern and retains antenna symmetry. The lowest tri-pole element 166 may be omitted without affecting symmetry.

Figure 33:
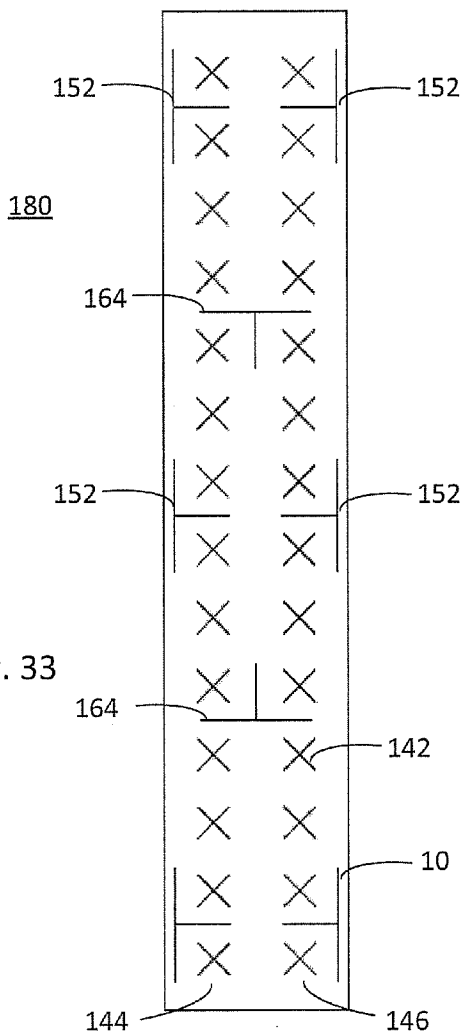
FIG. 33 is another example of a multiband base station antenna including tri-pole elements according to one aspect of the present invention.
Figure 32:
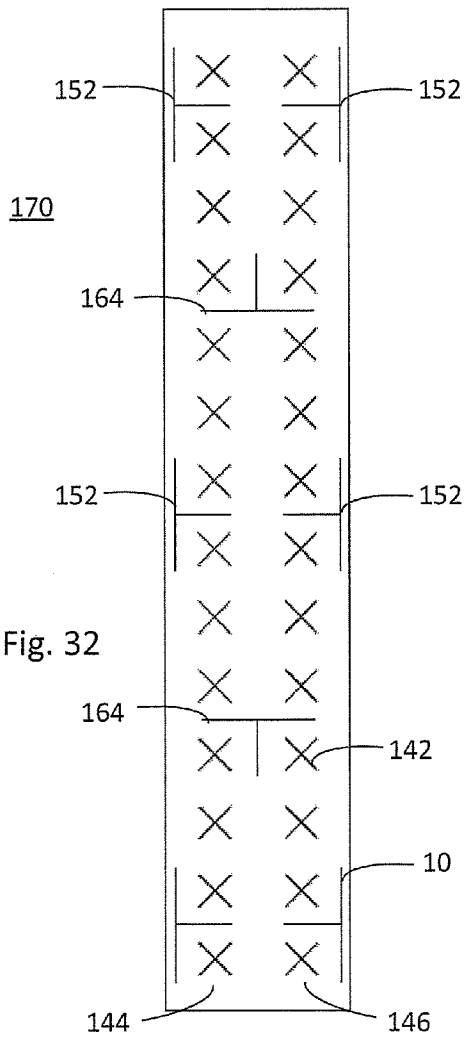
FIG. 32 is another example of a multiband base station antenna including tri-pole elements according to one aspect of the present invention.

FIGS. 32 and 33 illustrate additional embodiments of multiband antennas. These examples are similar to the example of FIG. 31 in that the low band tri-pole elements 152, 164 are arranged to form boxes. However, three high band elements 142 are inter-leaved between the tri-pole elements.

The invention claimed is:

1. A dual polarized base station antenna, comprising: a reflector having a longitudinal axis; an array of tri-pole elements disposed on the reflector, each tri-pole element having arms consisting of:

i. a first side arm;

ii. a second side arm; and iii. a central arm, approximately perpendicular to the first and second side arms;

said first side arm, said second side arm, and said central arm electrically connected to each other; wherein one of the first side arm and the center arm is parallel to the longitudinal axis; and a feed network having a first microstrip line coupled to the first arms of the tri-pole elements and a second microstrip line coupled to the second arms of the tri-pole elements, said first and second microstrip lines having a common ground conductor coupled to the central arm.

2. The dual polarized base station antenna of claim 1, wherein the array of tri-pole elements has two polarizations, oriented at +45 degrees and −45 degrees from the longitudinal axis.

3. The dual polarized base station antenna of claim 1, wherein the first and second side arms are parallel to the longitudinal axis.

4. The dual polarized base station antenna of claim 3, wherein the array of tri-pole elements are arranged such that alternating tri-pole elements are inverted with respect to each other.

5. The dual polarized base station antenna of claim 1, wherein the central arm is parallel to the longitudinal axis.

6. The dual polarized base station antenna of claim 5, wherein the array of tri-pole elements are arranged such that alternating tri-pole elements are inverted with respect to each other.

7. The dual polarized base station antenna of claim 1, wherein the array of tri-pole elements comprises a first set of tri-pole elements offset to the left with respect to the longitudinal axis and a second set of tri-pole elements offset to the right with respect to the longitudinal axis.

8. The dual polarized antenna of claim 1, further comprising a second array of tri-pole radiating elements, where each array of tri-pole elements is arranged such that the first and second side arms are parallel to the longitudinal axis, and the first and second arrays of tri-pole elements face opposite directions with respect to each other.

9. The dual polarized antenna of claim 8, further comprising at least one tri-pole element located at an end of the reflector and oriented such that the central arm is parallel to the longitudinal direction.

10. The dual polarized antenna of claim 1, wherein the first side arm, the second side arm, and the central arm have a loop shape.

11. The dual polarized antenna of claim 1, wherein the tri-pole elements include directors.

12. The dual polarized antenna of claim 11, wherein the directors are T-shaped with approximately the same orientation as the first and second side arms and the central arm.

13. A dual polarized multiband base station antenna, comprising:

a. a reflector having a longitudinal axis;

b. an array of low band connected tri-pole elements disposed on the reflector with a first operating range, each tri-pole element having arms consisting of:

i. a first side arm;

ii. a second side arm; and iii. a center arm, approximately perpendicular to the first and second side arms;

wherein one of the first side arm and the center arm is parallel to the longitudinal axis such that the array of tri-pole elements has two polarizations, oriented at +45 degrees and −45 degrees from the longitudinal axis;

c. said array of low band connected tri-pole elements with said first operating range having a first signal path coupled to the first arms of the low band connected tri-pole elements and a second signal path coupled to the second arms of the low band connected tri-pole elements, said first signal path and said second signal path having a common ground;

d. a first array of dual-polarized high band radiating elements with a second operating range higher than said first operating range; and e. said first array of dual-polarized high band radiating elements with said second operating range coupled to the dual polarized high band radiating elements.

14. The dual polarized base station antenna of claim 13, wherein the array of tri-pole elements comprises a first set of tri-pole elements offset to the left with respect to the longitudinal axis and a second set of tri-pole elements offset to the right with respect to the longitudinal axis.

15. The dual polarized base station antenna of claim 13, wherein the array of tri-pole elements comprises a first set of tri-pole elements wherein the first side arm is parallel to the longitudinal axis and a second set of tri-pole elements wherein the center arm is parallel to the longitudinal axis.

16. The dual polarized multiband antenna of claim 15, wherein the first set of tri-pole elements and the second set of tri-pole elements are arranged such that they form a box.

17. The dual polarized multiband base station antenna of claim 13, wherein the high band radiating elements are interspersed with the array of tri-pole elements.

18. The dual polarized multiband base station antenna of claim 13, further comprising: a second array of dual-polarized high band radiating elements.

19. The dual polarized multiband base station antenna of claim 18, wherein the first array of dual polarized high band radiating elements operate on a frequency band that is different from the frequency band of the second array of dual polarized high band radiating elements.

20. The dual polarized multiband base station antenna of claim 18, wherein the first and second arrays of dual polarized high band radiating elements operate in the same band.

* * * * *